United States Patent [19]

Nicholson

[11] Patent Number: 4,585,547

[45] Date of Patent: Apr. 29, 1986

[54] METHOD AND APPARATUS FOR CLEANING COAL

[76] Inventor: G. W. Nicholson, 801 Frank Nelson Bldg., Birmingham, Ala. 35203

[21] Appl. No.: 650,738

[22] Filed: Sep. 14, 1984

[51] Int. Cl.[4] ..... B03B 5/62; B03B 11/00; B02C 17/02

[52] U.S. Cl. ..... 209/3; 209/17; 209/156; 44/1 SR; 241/21; 241/24; 241/77; 241/88; 241/79.1

[58] Field of Search ..... 209/173, 3, 17, 209, 209/156, 157, 446, 44; 241/21, 77, 79.1, 88, 24; 44/1 SR

[56] References Cited

U.S. PATENT DOCUMENTS

| | | | |
|---|---|---|---|
| 756,214 | 4/1904 | Cornell | 241/21 |
| 1,792,179 | 2/1931 | McLean | 209/156 X |
| 2,139,047 | 12/1938 | Tromp | 209/156 X |
| 2,365,734 | 12/1944 | Tromp | 209/156 |
| 2,718,966 | 9/1955 | Hardinge | 209/173 |
| 3,165,269 | 1/1965 | Blackburn et al. | 241/21 X |
| 4,484,928 | 11/1984 | Keller, Jr. | 44/1 SR |

FOREIGN PATENT DOCUMENTS

| | | | |
|---|---|---|---|
| 19606 | 6/1899 | Fed. Rep. of Germany | 209/156 |
| 264510 | 1/1950 | Switzerland | 209/173 |

*Primary Examiner*—Frank W. Lutter
*Assistant Examiner*—Thomas M. Lithgow
*Attorney, Agent, or Firm*—Armstrong, Nikaido, Marmelstein & Kubovcik

[57] ABSTRACT

The present invention is directed to a method and apparatus for separating coal from impurities, which comprises a first and second tank including drag conveyor means and agitation means for the combination of saturating a raw mass containing coal and impurities, dispersing the impurities in to water, separating the coal from the impurities and flowing the mass from the front of the tanks to the rear of the tanks. A crusher as arranged between the tanks through conveyor means for transferring the mass between from one tank to the crusher and from the crusher to the other tank. The mass from the second tank is conveyed in to a separator pan which includes a separator plate, the separator plate having a configuration and being located within the separator pan at a position, so that an upper flow portion of the mass having a lower specific gravity passes thereover, and so that a lower flow portion of the mass having a higher specific gravity passes thereunder and out a hole in the bottom of the separator. A collector bin is located at an output flow end of the separator pan for collecting coal particles from the upper flow portion of the mass flowing over the separator.

19 Claims, 4 Drawing Figures

METHOD AND APPARATUS FOR CLEANING COAL

BACKGROUND OF THE INVENTION

1. Field of the Invention

This invention relates to a method of and an apparatus for separating coal and other minerals from refuge as found in gob piles containing coal or from mining especially dirty coal. The present invention utilizes gravitational separation of the various components in the raw coal material, which is assisted by agitating a mixture of the raw coal material in water.

2. Description of the Prior Art

There are numerous known methods and systems for separating selected particulate material from mixtures of liquids and solids, including separating coal or ore into two products, according to their specific gravity. For example U.S. Pat. No. 3,410,407 proposes a method and apparatus for separating coal or ore into two products according to their specific gravity by the use of an apparatus including a washing tank with a sloping front wall, a sloping rear wall and sides which is filled with a liquid having a particular specific gravity. This method is disadvantageous in that is requires the use of a liquid suspension having a specific gravity of, for example, 1.5. Also, the procedures of this patent require a quiescent zone to be formed within the washing tank, the construction of which necessitates floatation on the surface of the liquid suspension of coal having a specific gravity lower than that of the liquid suspension.

U.S. Pat. No. 4,222,857 proposes an apparatus for separating a mixture of solids, utilizing an electric, double layer between two phases which are charged relative to one another, which is brought about by the reaction of a special chemical reagent. This U.S. patent uitlizes a trough-shaped vessel with substantially quiescent low conditions. Procedures of this patent are complicated and require the use of a special chemical reagent. Also, the design of the trough-shaped vessel is inflexible in that it cannot be adjusted to accommodate fluctuations in flow rates and, in particular, fluctuations in the amount of materials to be separated.

Further, the foregoing patents by the use of quiescent conditions require precise maintenance of flow conditions which is necessary for the delicate gravity separation upon which their inventions are based.

SUMMARY OF THE INVENTION

The present invention is directed to method and apparatus for separating coal and other minerals from refuge as found in glob piles or from mining coal. The present invention creates a suspension of the raw coal material in water and then agitates the suspension. The agitation of the suspension may be achieved by agitation means, such as jets of high pressure water, in combination with drag conveyor means. The agitation of the suspension provides a combination of saturating the raw coal material with water, dispersing the impurities in the raw coal material into the water, and dissociating the coal from the impurities contained in the raw coal material. In addition, the combination of the drag conveyor means and the agitation means assist in transfer or flow of the mass from one part of the apparatus of the invention to another part.

After the suspension is agitated, it is then crushed. The crushed suspension is treated by agitation means in the same manner as discussed above for further saturation of the raw coal material with water, dispersing the impurities in the raw coal material into water and dissociating the coal from the impurities contained in the raw coal material, as well as assisting in the flowing of the mass as desired.

After the raw coal material is treated as discussed above, it is passed to a separator pan having a particular construction, including a separator plate having a configuration and being located within the separator pan at a position, so that an upper portion of the flow mass having a lower specific gravity passes over the separator plate and so that a lower flow portion of the mass having a higher specific gravity passes under the separator plate and out a hole located in the bottom of the separator pan.

In addition, the present invention includes flowing the upper flow portion of the mass which has flowed over the separator pan into a collector bin. Thereafter, the coal can be transferred to a washer, if desired.

DESCRIPTION OF THE PREFERRED EMBODIMENTS

Figure 1:
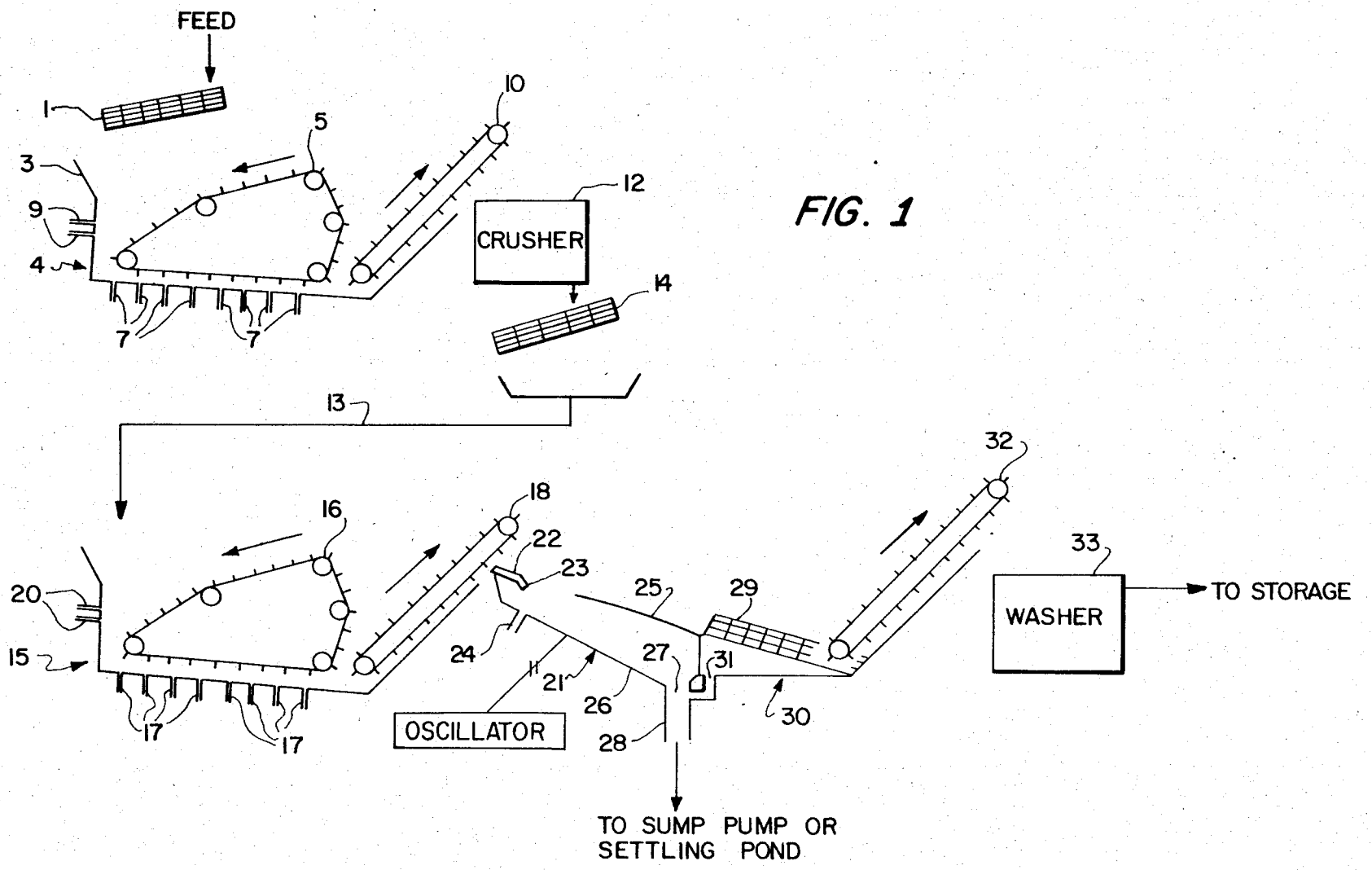
FIG. 1 is a diagramical side view illustrating a typical apparatus and method of the present invention, including a side view of the combination of the separation pan. and collection bin assembly of the present invention.
Figure 2:
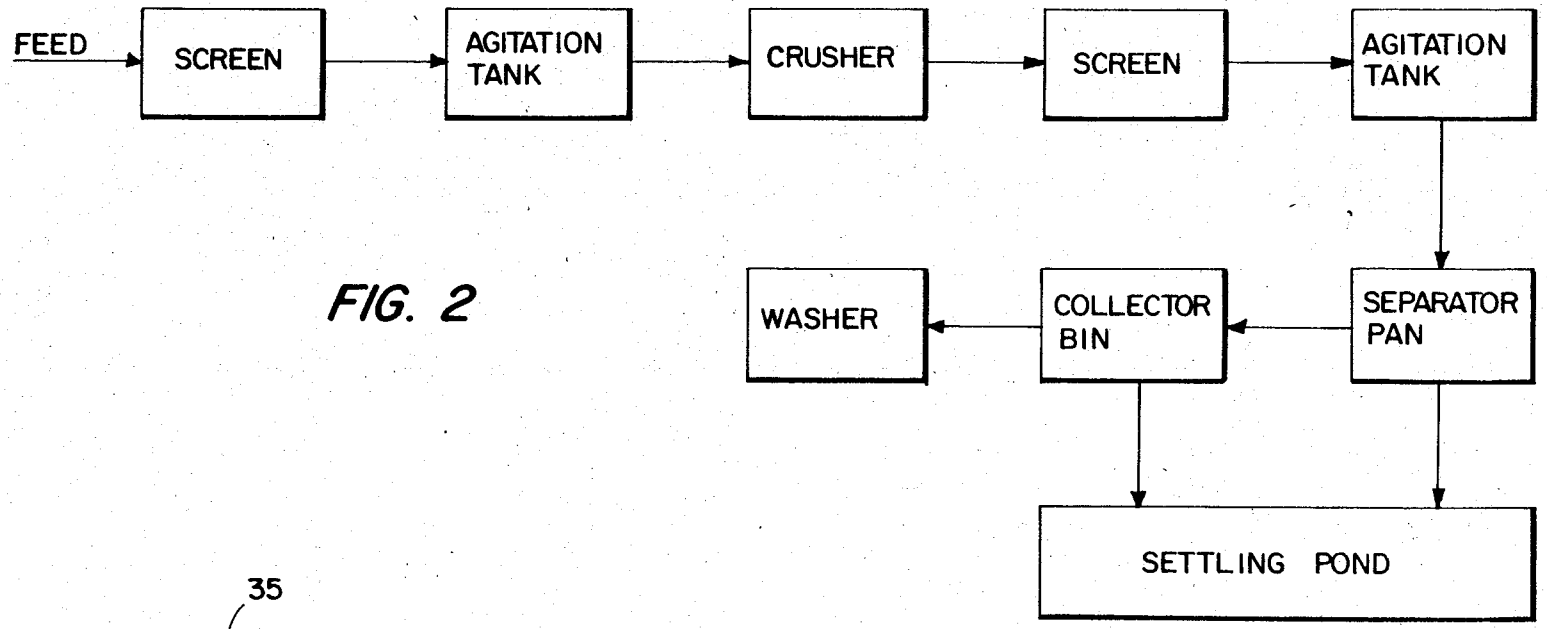
FIG. 2 is a flow diagram of the process of the present invention.

In the present invention, the raw mass containing coal (mined coal, for example) is dumped onto a screen placed over a first pan or tank. The screen is of a predetermined size, generally, slightly larger than any lumps of coal to be found in the raw mass. The screen may be slightly tilted and may be slowly vibrated, which removes all rocks and other refuge of a size larger than the opening in the screen. The screen may be omitted if the larger sized particles need not be removed.

The mass passes through the screen and drops into the front portion of the first pan which contains water. The water level in the pan is maintained at such a level that the mass may be completely submerged or dispersed. The bottom of the pan may be tilted downward from its front to rear to facilitate the flow of the mass toward the rear portion of the pan which is associated with conveyor means for removing the mass. The pan is equipped with a drag conveyor along its bottom which constantly moves the mass toward the conveyor means.

The pan may be equipped with agitation means, along its bottom for example such as a number of pressurized air ducts and/or water ducts. Agitation by the high pressure flow of water, for example, serves two purposes: It assists in moving the mass toward the conveyor means and, more importantly, agitates the mass, resulting in breaking up the lumps of clay and dirt suspending the clay in the water, and dissociating the coal from the refuge. The tank may also be equipped with a water overflow valve.

The mass is moved along the pan by the drag conveyor and agitation means toward the conveyor means. The conveyor means removes the mass and water from the first pan and dumps the mass and water into a crusher.

Additional water can be added to the mass as the crushing takes place to assist in maintaining a constant, even, manageable, uniterrupted flow of the mass; to assist in continuing to break up all the lumps of dirt and clay, and to assist in dissociating the coal from the refuge.

The mass is then flowed from the crusher into the second pan, which is constructed similar to the first pan, with a drag conveyor, agitation means, etc. Again, the mass is pushed toward the conveyor means by the drag conveyor and agitation means, thereby providing a constant, even, manageable, uninterrupted flow of the mass which is eventually and continuously moved toward the washer.

If the rock is extremely hard, or if rock constitutes a large portion of the mass, the crusher may be constructed whereby only the coal and soft mass will be crushed, and the larger rocks will pass through the crusher. In such an event, a second screen would then be located at the outflow from the crusher causing all rocks above the desired size of the coal to be removed by the screen.

As the mass and water is picked up by the conveyor means leaving the second pan, all the clay should be suspended in the water, all the coal should be dissociated from the dirt and clay and there should be no lumps of dirt and clay remaining.

The mass is removed from the second pan by the conveyor means into a separator pan. The conveyor means empties the mass and water onto the front portion of a grooved metal plate which spreads the mass and water rather evenly across its surface, so that the mass and water enter the separator pan near the surface of the water in the separator pan. The grooved metal plate is slightly bent outward at its rear and lower portion, so that the mass and water flow onto the surface or near the surface of the water in the separator pan. This slight bend outward at the rear and lower portion of the grooved metal plate can provide flat portion which begins above the water level in the separator pan and which ends below the water level in the separator pan.

As the mass and water enter the separator pan, additional water may be added to assist the coal in floating along or rising toward the surface of the water.

The separator pan is either flat or concave on its bottom, from side to side. The mass enters the separator pan at its front end. At the point where the mass enters the separator pan its bottom commences to decline toward its rearward end. Protruding from the rearward end of the separator pan, opposite the end where the mass enters, is the separator plate. There is a hole located at the bottom of the decline in the separator pan, where the rock and other refuge with a high specific gravity will flow out to the sump pump or settling pond, together with much of the water saturated with clay. The separator plate protrudes a distance beyond the hole toward the front end of the separator pan so that a proper pulling action is achieved for assuring proper flow of the material with a higher specific gravity out of the hole. The separator plate may be adjustable, so that its vertical distance from the bottom of the separator pan can be decreased or increased. This permits adjustment of the separator plate so that a portion of the mass predominantly containing coal flows over the top of the separator plate and that the portion of the mass containing compounds heavier than the coal flows beneath the separator plate.

When the mass enters the separator pan, the rock and other refuge with a higher specific gravity than the coal, together with much of the water saturated with clay and dirt, will immediately begin to sink and flow down the incline, through the hole in the bottom of the separator pan, out the pipe to the settling pond or the sump pump.

The coal and the lighter refuge will flow over the separator onto a screen into the collector bin. The screen has a mesh size such that the coal particles will be retained on the screen and that the water containing the remaining clay will pass through the screen and thereby be separated from the coal. The screen may be slanted and/or be vibrated to facilitate the separation of the coal in the bin. Conveyor means remove the coal and remaining mass from the bin into the washer.

The water containing the remaining clay which has been separated from the coal will flow out the bin to the sump pump or settling pond.

The following description of the present invention will be made by referring to the drawings, which illustrate but do not limit the present invention.

The raw mass containing coal is dumped on to the screen 1. A screen with six-inch openings can be desirably used, because there will generally not be any coal particles larger than six inches in diameter. The screen is tilted slightly causing the large rocks and other large size refuge to be removed from the mass into a pile on the side of pan or tank 4, which may be opposite from the side where the mass is dumped onto the screen. As the mass is dumped onto the screen, the screen is vibrated by a motor (not shown). If the refuge contains such a large amount of clay as to cause any problem with the mass flowing through the screen, a stream of water (not shown) may be directed into the mass causing the mass to flow through the screen.

The pan may have an extension of the top on to the side 3 underneath the screen, causing the mass to slide into the pan. The pan 4 may be rectangular in shape and the bottom slightly tilted forward toward the elevator conveyor means 10.

Also, the rear portion of pan 4 or, in other words, the end opposite to where the mass enters, may be inclined outwardly. Along the bottom of pan 4 may be a drag conveyor 5 equipped with a drag means located on a chain or rope approximately 12 inches apart. A screw or auger conveyor could be used in place of the drag conveyor 5. The drag conveyor extends along the bottom from one end of pan 4 to the elevator conveyor means 10, where the drag conveyor 5 proceeds upward, then to the opposite end of pan 4 and connects with the drag conveyor at that point making a fattened circle. The drag conveyor 5 is pulled by a motor (not shown).

In the bottom of pan 4 there are a number of agitation means, such as the pressurized water ducts 7. The pressurized water is supplied by a pump (not shown).

The elevator conveyor means (10) are located on the rearward end of pan 4 and lift the water and mass out of pan 4 and convey the water and mass into the crusher 12. The elevator buckets are pulled by a motor (not shown). The water level in pan 4 is maintained at a constant level by water valves 9.

The function of screen 1 is to remove all large rocks and other large refuge from the raw mass. The function of pan 4 is to thoroughly wet the mass, whereby the mass becomes as saturated as possible, the lumps of dirt and clay disperse, and the coal is dissociated from the clay and dirt, and to provide a constant, even, manageable and uninterrupted flow of the mass into the crusher.

As the mass and water is dumped into crusher 12, the mass is either crushed to the desired size of the coal or the crusher is constructed whereby the coal and soft portion of the mass are crushed and the rock is passed through.

If crusher 12 crushes everything to the desired size of the coal, the mass then flows into pan or tank 15. The size to which the mass is crushed shall be determined by the intended use of the coal and the effect of the size of the mass on the separation process. The fundamental effect on the separation process being that the larger lumps of coal decline faster in water; causing more slate and other refuge with a smaller specific gravity to pass over the separator into the bin with the coal. As a result, the smaller the size of coal particles, the better the separation process. A size of 1-inch is probably most desirable.

If the rock and other large refuge is extremely hard or constitutes an extremely large amount of the refuge, the crusher can be constructed whereby the large rock (all rock above 1-inch which came through the six-inch screen) and other such size refuge will pass through and the coal and soft refuge will be crushed to the desired size. In such an event, a second screen 14 would then be placed at the outflow from the crusher. The second screen can be tilted in the same manner as screen 1 and vibrated by a motor as screen 1.

The crushed mass is flowed from crusher 12 to pan 15 by conveyor means 13, which may be an elevator conveyor means or a screw or auger conveyor means. Optionally, the flow of crushed mass from crusher 12 to pan 15 could be achieved by gravity flow. In this situation, the crusher 12 could be positioned at a level higher than pan 15, so that the crushed mass would flow from the crusher into the pan by gravity.

Pan 15 is constructed identical to pan 4 and equipped with a drag conveyor 16 similar to drag conveyor 5 and agitation means 17 similar to agitation means 7, supplied with pressurized water from a pump (not shown). Drag conveyor 16 and agitation means 17 move the mass toward conveyor 18, and agitate the mass into the water.

The functions of pan 15 are to thoroughly wet the mass, whereby the mass becomes as saturated as possible, the lumps of dirt and clay to disperse, and the coal is dissociated from the clay and dirt, and to provide a constant, even, manageable and uninterrupted flow of the mass into the separator pan. Additional water may be supplied as needed by pipes 20.

The elevator conveyor means 18 are pulled by a motor (not shown) and convey the mass and water into separator pan 21.

The elevator conveyor means 18 dump the mass and water onto a grooved plate 22 located in the front of separator pan 21, which spreads the mass rather evenly across the surface of the water in separator pan or tank 21. The plate 22 is curved slightly at its lower end 23 which causes the mass to flow into the water in separator pan 21 either on the surface or slightly beneath the surface. Additional water may be supplied to separator pan 21 by pipes 24.

Figure 3:
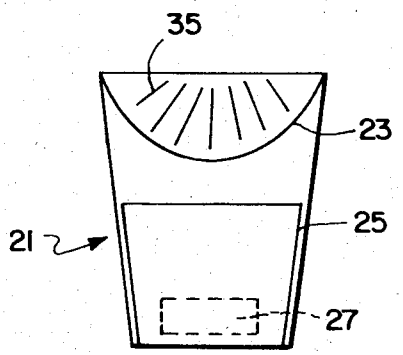
FIG. 3 is a top view of the separator pan.
Figure 4:
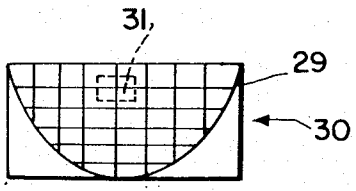
FIG. 4 is a top view of the collector bin.

The grooved plate 22 has radially extending grooves or protruberences 35, as shown in FIG. 3, which assist in spreading the mass evenly across the surface of the water in separator pan 21.

Commencing at the rearward end of separator pan 21 and protruding in the direction from whence the mass and water was dumped into separator pan, is the separator plate 25. The bottom of separator pan may be either flat or concave from side to side. At the point where the mass enters the separator pan, the bottom begins to decline 26 toward the opposite end. The rate of decline must be sufficient to cause the sand, dirt and rock to flow to the hole 27, located at the bottom of the decline. The separator plate 25 protrudes sufficiently in length toward the opposite end of the separator pan so that the suction of hole 27 will not pull any coal down and into the hole 27. On the contrary, the suction created should be such as to only cause the dirt, sand and rocks to move more freely down the decline.

The separator pan 21 may be reduced in width from the end where the mass enters to the end where hole 27 is located, as shown in FIG. 3.

The separator pan may be constructed with an oscillator; which oscillation would assist in causing the coal in the mass to float or rise and refuge in the mass to sink.

A pipe 28 is connected to hole 27 which extends to a sump pump or settling pond.

The function of separator pan 21 is to receive the mass spread over the water's surface or slightly underneath the surface. Additional water may be added through pipes 24 to assure a flow sufficient to float or raise the coal over the separator and into the collector bin 30. At the same time, all the mass of a higher specific gravity than the coal and much of the water heavily laden with dispersed clay, will begin to sink down the decline 26, into and through hole 27 out through pipe 28 to the sump pump or settling pond.

The coal and the remaining refuge flows over separator 25 out of separator pan 21, onto screen 29 into collector bin 30. The conveyor means 32 then conveys the coal and remaining refuge from bin 30 into the washer 33. The conveyor means 32 are constructed in such a manner that no water is conveyed by them from the bin to the washer 33, for example, it can be constructed with using buckets with holes in the bottom. The remaining water containing the clay and dirt then flows from the collector bin 30 out hole 31 into and through pipe 28 to the sump pump or settling pond.

The separated and washed coal may then be transferred to a storage bin by conventional means.

Specific gravity is the basis upon which all separation of coal from other material is accomplished by the present invention. The very first task in the construction of the apparatus of the present invention and the process parameters associated therewith is to determine the composition of the raw mass containing the coal and to make a specific gravity analysis of the coal and of each of the separate materials from which the coal is to be separated. After determining the specific gravity of the coal and the specific gravity of each of the separate materials contained in the mass; and determining the quantity of coal contained per unit of the mass; and determining the desired quantity of coal to be separated during an established period of time; one can then mathematically calculate the rate of fall of the coal and of each of the separate materials composing the mass; the size of the pans; the size and speed of the drag conveyor; the required quantity and the necessary rate of flow of water in each pan and the crusher; the size of outlets 27 and 31; and if a washer will be reqired or desirable.

Typical gob piles of raw mass containing coal will contain approximately 30% coal. Of the gob piles in which specific gravity analysis were made, there were four main components therein: coal, approximately 30%; slate, approximately 36%; clay, approximately 11%; and rock, approximately 23%. The coal had a specific gravity of 1.35 to 1.7. The slate had a specific gravity from 1.6 to 1.9. The rock had a specific gravity in excess of 2.0.

By established formula known to those skilled in the art, the fall rate of each of the components of the mass in the separator pan can be calculated. By adjusting the height of the separator plate and the rate of the flow of the water, all the mass in the above-analyzed gob pile with a specific gravity of 1.7 and less can be caused to flow over the separator plate, and the remainder of the mass will then be caused to flow under the separator plate and out hole 27, and all the clay be removed with the outflow of the water. Under these conditions, the percentage of coal in the separated portion will be approximately 71% and the percentage of refuge approximately 29%.

The final cleaning may be accomplished with either a table, a jig washer or a cyclone washer, each of which may be obtained in the open market. Since a large percentage of the recovered coal will be relatively fine, a cyclone may be preferred.

To obtain an output of 400 tons of coal per eight-hour day from the above-analyzed gob pile, it would be necessary to process approximately 1,500 tons of gob per day; or approximately 187 tons per hour. By established mathematical formula, one can then calculate the size of each component of the plant, the rate of the flow of water and mass, to obtain the desired output.

If the difference in the specific gravity of the coal and the specific gravity of the refuge is very large—such as only rock and coal—the separation may be completed by this process without the added use of the washer or tables.

Should the refuge have a smaller specific gravity than the coal, the proceedure shall be reversed with the coal falling underneath separator 25, through outlet 27, then into the washer—or if acceptably clean—into the storage bin. The refuge would then flow into collector bin 30, out outlet 31 into pipe 28, into the settling pond or sump pump. Outlet 31 and pipe 28 would not, of course, be connected in this embodiment as shown, and a screen for collecting the coal would be associated separator pan 21 for collecting the coal particles.

I claim:

1. A system for separating coal from impurities, which comprises:

a first tank with a first and a second end, means for transferring a raw mass containing coal and impurities to the first end of the first tank, the first tank having means including drag conveyor means and agitation means for the combination of saturating the raw mass with water, dispersing the impurities into water, dissociating the coal from the impurities, and flowing the dissociated mass toward the second end of the first tank, a crusher for crushing the dissociated mass, conveyor means located in the second end of the first tank for transferring the mass to the crusher, a second tank with a first and second end, means for transferring the crushed mass from the crusher to the first end of the second tank, the second tank having means including drag conveyor means and agitation means for the combination of saturating the crushed mass with water, dispersing the impurities into water, dissociating the coal from the impurities, and flowing the second dissociated mass toward the second end of the second tank, a separator pan having a first end, a second end and a hole in its bottom and a body of water therein, means for transferring the second dissociated mass from the second end of the second tank to the first end of the separator pan, means located at the first end of the separator pan for receiving the second dissociated mass from the second tank and for spreading the mass substantially evenly across the surface of the water in said separator pan, the separator pan including a separator plate, the separator plate having a configuration and being located within the separator pan at a position relative to said hole to enable flowing an upper flow portion of the second dissociated mass having a lower specific gravity thereover and flowing a lower flow portion of the second dissociated mass having a higher specific gravity thereunder and out the hole in the bottom of the separator pan, a collector bin located at an position on the separator pan for collecting coal particles, and means for removing the collected coal out of the system and means for removing the impurities out of the system.

2. A system as claimed in claim 1, wherein the means for spreading the second dissociated means comprises a grooved plate.

3. A system as claimed in claim 2, wherein the collector bin includes a screen, and the collector bin is located at the second end of the separator pan for collecting coal particles from the upper flow portion of the mass flowing over the separator plate pan.

4. A system as claimed in claim 3, further comprising a washer positioned to receive the removed collected coal.

5. A system as claimed in claim 3, wherein the agitation means are high pressure water jets.

6. A system as claimed in claim 3, wherein the separator pan includes oscillation means for vibrating the separator pan and for assisting in materials with a higher specific gravity sinking towards the hole.

7. A system as claimed in claim 3, wherein the first and second tank include water supply means for maintaining a constant water level within the tanks.

8. A system as claimed in claim 3, wherein a screen is arranged between the means for transferring the raw mass to the first end of the first tank and the first tank for removing larger particles contained in the mass.

9. A system as claimed in claim 3, wherein a screen is arranged between the crusher and the means for transferring the crushed means from the crusher to the first end of the second tank for removing larger particles.

10. A system as claimed in claim 3, wherein the separator pan includes water inlet pipes for assuring a sufficient flow of the second dissociated mass and for assisting in materials with a higher specific gravity sinking towards the hole.

11. A process for separating coal from impurities, which comprises:

suspending a raw mass containing coal and impurities in water, agitating the suspension sufficiently to saturate the raw mass with water, disperse the impurities into the water and to dissociate the coal from the impurities, crushing the dissociated mass, suspending the crushed mass in water, further agitating the crushed mass suspension sufficiently to further saturate the crushed suspended mass with water and to further disperse the impurities into the water and to further dissociate the coal from the impurities, spreading the further dissociated mass substantially evenly across the surface of a body of water in a separator pan having a hole in its bottom and a separator plate therein, flowing the further dissociated mass in said separator pan to create an upper flow portion and a lower flow portion of different specific gravities, intersecting said upper and lower flows by the separator plate so that the upper flow portion flows over the separator plate and the lower flow portion flows under the separator plates, collecting the separated coal particles.

12. A method as claimed in claim 11, wherein the upper flow portion is passed over a screen for collecting coal particles therein.

13. A method as claimed in claim 12, wherein the collected coal particles are washed.

14. A method as claimed in claim 12, wherein the agitation of the suspensions is achieved by utilizing high pressure water.

15. A method as claimed in claim 12, including oscillating the separator pan.

16. A method as claimed in claim 12, wherein additional water is added for maintaining the suspensions.

17. A method as claimed in claim 12, wherein the raw mass is passed through a screen before forming the suspension for removal of larger particles contained therein.

18. A method as claimed in claim 12, wherein the crushed mass is passed through a screen for removing larger particles.

19. A method as claimed in claim 12, wherein additional water is added in the separator pan, thereby assuring a sufficient flow of the further dissociated mass and assisting in the materials with a higher specific gravity sinking towards a hole in the bottom of the separator pan.

* * * * *